US009399806B2

(12) United States Patent
Soniak et al.

(10) Patent No.: US 9,399,806 B2
(45) Date of Patent: Jul. 26, 2016

(54) TITANIUM ALLOY COMPOSITION FOR THE PRODUCTION OF HIGH-PERFORMANCE PARTS, IN PARTICULAR FOR THE AERONAUTICAL INDUSTRY

(75) Inventors: Francis Soniak, Paris (FR); Jean-Michel De Monicault, Croisy sur Eure (FR)

(73) Assignee: MESSIER-BUGATTI-DOWTY, Velizy Villacoublay (FR)

( * ) Notice: Subject to any disclaimer, the term of this patent is extended or adjusted under 35 U.S.C. 154(b) by 488 days.

(21) Appl. No.: 13/376,882

(22) PCT Filed: Jun. 8, 2010

(86) PCT No.: PCT/EP2010/058038

§ 371 (c)(1), (2), (4) Date: Jan. 31, 2012

(87) PCT Pub. No.: WO2010/142701

PCT Pub. Date: Dec. 16, 2010

(65) Prior Publication Data

US 2012/0118444 A1 May 17, 2012

(30) Foreign Application Priority Data

Jun. 8, 2009 (FR) ..... 09 02754

(51) Int. Cl.
*C22C 14/00* (2006.01)
*C22F 1/18* (2006.01)

(52) U.S. Cl.
CPC .. *C22C 14/00* (2013.01); *C22F 1/18* (2013.01)

(58) Field of Classification Search
CPC ..... C22C 14/00; C22F 1/18
USPC ..... 148/669; 420/420
See application file for complete search history.

(56) References Cited

U.S. PATENT DOCUMENTS 4,810,465 A * 3/1989 Kimura et al. ..... 420/417

FOREIGN PATENT DOCUMENTS

| | | | |
|---|---|---|---|
| EP | 1 114 876 | A1 | 7/2001 |
| EP | 1 302 554 | A1 | 4/2003 |
| EP | 1 302 555 | A1 | 4/2003 |
| RU | 2 122 040 | C1 | 11/1998 |

* cited by examiner

*Primary Examiner* — Jie Yang
(74) *Attorney, Agent, or Firm* — Sughrue Mion, PLLC

(57) ABSTRACT

A titanium alloy having at least 4% by weight aluminum and at least 0.1% by weight oxygen, the alloy also including at least one element selected from vanadium, molybdenum, chromium, and iron. The titanium alloy also includes hafnium in a proportion by weight of at least 0.1%.

5 Claims, No Drawings

TITANIUM ALLOY COMPOSITION FOR THE PRODUCTION OF HIGH-PERFORMANCE PARTS, IN PARTICULAR FOR THE AERONAUTICAL INDUSTRY

CROSS REFERENCE TOP RELATED APPLICATIONS

This application is a National Stage of International Application No. PCT/EP2010/058038 filed Jun. 8, 2010, claiming priority based on French Patent Application No. 09 02754, filed Jun. 8, 2009, the contents of all of which are incorporated herein by reference in their entirety.

The invention relates to a novel titanium alloy composition having high-grade mechanical characteristics for fabricating high-performance parts, in particular for the aviation industry, such as landing gear elements or turbine disks.

TECHNOLOGICAL BACKGROUND OF THE INVENTION

Various types of titanium alloy having high-grade mechanical characteristics are known that include a significant proportion of aluminum, such as for example Ti 6-4 (6% aluminum and 4% vanadium), Ti 8-1-1 (8% aluminum, 1% molybdenum, and 1% vanadium), and also Ti 10-2-3 (10% vanadium, 2% iron, and 3% aluminum), where the percentages represent a proportion by weight relative to the total weight. Titanium alloys are also known that are of the quasi-beta type, having a large proportion of aluminum and also of oxygen. An example of such an alloy is given by document EP 1 302 555 that describes a titanium alloy presenting the following composition, expressed as percentages of total weight:

| | |
|---|---|
| Aluminum | 4.0 to 6.0 |
| Vanadium | 4.5 to 6.0 |
| Molybdenum | 4.5 to 6.0 |
| Chromium | 2.0 to 3.6 |
| Iron | 0.2 to 0.5 |
| Zirconium | 0.7 to 2.0 |
| Oxygen | not more than 0.2 |
| Nitrogen | not more than 0.05 |
| Titanium | balance |

Such alloys are for hot forging at a temperature that is close to the $\beta \rightarrow \alpha+\beta$ polymorphic transition temperature, and then for subjecting to heat treatment during which the part is heated to a temperature close to the $\beta \rightarrow \alpha+\beta$ polymorphic transition temperature in order to cause a beta phase to appear that coexists with an alpha phase, followed by staged cooling and aging of the part. The purpose of such treatment is to obtain a large proportion of beta phase in the finished part, so as to give it great mechanical strength. In this respect, elements, such as vanadium, molybdenum, chromium, or iron contribute to stabilizing the beta phase while the part is cooling, thus making it possible to "freeze" a large portion of the alloy in this phase.

Nevertheless, promoting the beta phase generally takes place to the detriment of the alpha phase (typically representing 60% to 70% of the weight of a part made in this alloy), which alpha phase enhances the toughness of the part. In order to mitigate that drawback, a non-negligible proportion of zirconium is added to the composition in order to enhance alpha phase stabilization during cooling, by forming solid solutions with the alpha titanium, with which zirconium is relatively similar in terms of density and melting temperature.

The use of such a composition and the implementation of appropriate forging and heat treatment methods (in particular cooling that encourages the above-mentioned solid solution) enable solid titanium parts to be produced that present an advantageous compromise between toughness and mechanical strength.

OBJECT OF THE INVENTION

The invention seeks to propose a novel titanium alloy composition having the potential of enabling better mechanical characteristics to be obtained.

BRIEF DESCRIPTION OF THE INVENTION

In order to achieve this object, the invention provides a titanium alloy particularly suitable for hot forging at a temperature close to the $\beta \rightarrow \alpha+\beta$ polymorphic transition temperature and for heat treatment with heating to a temperature close to said transition temperature, the alloy including, in addition to titanium constituting the majority proportion by weight, at least 4% by weight of aluminum, at least 0.1% by weight of oxygen, at least 0.01% by weight of carbon, the alloy also including at least one element selected from vanadium, molybdenum, chromium, and iron. According to the invention, the titanium alloy also includes hafnium at a proportion by weight of at least 0.1%.

The inventors take the view that an increase in the proportion of aluminum and/or oxygen compared with known compositions leads to an increase in the $\beta \rightarrow \alpha+\beta$ polymorphic transition temperature, thereby enabling forging to be performed at a higher temperature, and thus contributing to reinforcing the mechanical strength characteristics of the final part. Nevertheless, the inventors suspect that the increased presence of aluminum and oxygen in the above-mentioned alloys runs the risk of giving rise to phenomena whereby the component ingredients of the alloy segregate during cooling, which can make the material more fragile. In particular, aluminum and oxygen appear to be the cause of oxidizing phases precipitating, which phases have a negative effect on the final mechanical performance of the part.

In order to diminish those drawbacks, the inventors propose accompanying this increase with a significant contribution of hafnium, where hafnium has particularly strong affinity for oxygen and appears to facilitate the precipitation of alloy phases by binding with oxygen, thereby avoiding the formation of oxidizing phases of aluminum and titanium, such that the negative effect associated with increasing the proportions of aluminum and oxygen is, if not eliminated, at least greatly attenuated.

The use of hafnium presents several advantages. In addition to its above-mentioned affinity with oxygen, hafnium has an electron structure that is comparable to that of zirconium. The inventors therefore take the view that, like zirconium, it is capable of enhancing stabilization of the alpha phase of titanium by forming solid solutions therewith. In addition, hafnium presents continuous solubility in the beta phase, and complete miscibility in the alpha phase of titanium.

Finally, it is present in the state of traces in certain titanium minerals. Measurements undertaken on various minerals show that the proportion of hafnium in the mineral does not exceed 0.05%. It therefore appears advantageous to avoid seeking to eliminate this ingredient from the mineral, and on the contrary to enrich the mineral with hafnium in order to obtain the proportion recommended by the invention.

Advantageously, such an alloy is subjected after forging to the following heat treatment:

heating to a temperature in a range of 30 degrees Celsius (° C.) to 70° C. below the β→α+β polymorphic transition temperature of the alloy;

pausing at said temperature for 2 hours (h) to 5 h;

cooling, preferably in air;

pausing at a temperature in the range 540° C. to 600° C. for a period of 8 h to 16 h; and cooling, preferably in air.

DETAILED DESCRIPTION OF THE INVENTION

As embodiments, three typical compositions are given below, and in each of them one particular example is described in detail. The proportions given are proportions by weight.

| | Composition 1 | Composition 2 | Composition 3 |
|---|---|---|---|
| Aluminum | 4.0% to 7.5% | 4.0% to 7.5% | 4.0% to 7.5% |
| Vanadium | 3.5% to 5.5% | 3.5% to 5.5% | 3.5% to 5.5% |
| Molybdenum | 4.5% to 7.5% | 4.5% to 7.5% | 4.5% to 7.5% |
| Chromium | 1.8% to 3.6% | 1.8% to 3.6% | 1.8% to 3.6% |
| Iron | 0.2% to 0.5% | 0.2% to 0.5% | 0.2% to 0.5% |
| Hafnium | 0.1% to 1.1% | 0.1% to 0.7% | 0.1% to 0.7% |
| Zirconium | — | 0.1% to 0.7%* | 0.1% to 0.7%* |
| Silicon | — | — | 0.05% to 0.25% |
| Oxygen | 0.1% to 0.3% | 0.1% to 0.3% | 0.1% to 0.3% |
| Carbon | 0.01% to 0.2% | 0.01% to 0.2% | 0.01% to 0.2% |
| Titanium | Balance | Balance | Balance |

*The total proportion by weight of hafnium plus zirconium remains less than 1%.

The following alloy No. 1 is selected, in particular, in compliance with composition No. 1:

| | |
|---|---|
| Aluminum | 7.0% |
| Vanadium | 4.5% |
| Molybdenum | 6.5% |
| Chromium | 3.0% |
| Iron | 0.4% |
| Hafnium | 0.9% |
| Oxygen | 0.3% |
| Carbon | 0.05% |
| Titanium | Balance |

The high proportion of aluminum (7.0% compared with the 5% normally encountered in known alloys such as Ti 5-5-5-3 or VT22) and the high proportion of oxygen (0.3% compared with less than 0.2% in Ti 5-5-5-3) should be observed. It should also be observed that the proportion by weight of molybdenum is relatively high, thereby enabling even stronger stabilization of the beta phase. Finally, it should be observed that the proportion by weight of hafnium is selected here to be approximately equal to three times the proportion by weight of oxygen.

The following alloy No. 2 is also selected in compliance with composition No. 2:

| | |
|---|---|
| Aluminum | 7.0% |
| Vanadium | 4.5% |
| Molybdenum | 6.5% |
| Chromium | 3.0% |
| Iron | 0.4% |
| Hafnium | 0.5% |
| Zirconium | 0.5% |
| Oxygen | 0.3% |
| Carbon | 0.05% |
| Titanium | Balance |

This adds the effect of zirconium that, in addition to its propensity for stabilizing the alpha phase of titanium, also appears to present an affinity with oxygen that is advantageous, such that the zirconium acts together with the hafnium to capture the oxygen and thus avoid the precipitation of oxidizing phases of aluminum and titanium. The combined presence of these two elements also appears to present a synergy effect, further reducing the segregation of the species constituting the alloy during cooling of the alloy.

Finally, the following alloy No. 3 is selected, in accordance with composition No. 3:

| | |
|---|---|
| Aluminum | 7.0% |
| Vanadium | 4.5% |
| Molybdenum | 6.5% |
| Chromium | 3.0% |
| Iron | 0.4% |
| Hafnium | 0.5% |
| Zirconium | 0.3% |
| Silicon | 0.15% |
| Oxygen | 0.3% |
| Carbon | 0.05% |
| Titanium | Balance |

Although it is in the same column of Mendeleev's table as zirconium or hafnium, silicon also appears to have a beneficial effect in opposing the precipitation of oxidizing phases of aluminum and titanium.

In the alloys taken as examples of the compositions, the proportions are given to within ±10% in relative value. For example, in alloy No. 1, the proportion of aluminum lies in the range 6.3% to 7.7%, and the proportion of hafnium lies in the range 0.81% to 0.99%.

Using these alloys, it is proposed to fabricate half-finished products by successive forging operations in the β, α+β, β, α+β zones with final deformation in the α+β zone. The product as forged in this way is then subjected to the following heat treatment:

temperature raised to 790° C.;

pause at said temperature for 3 h;

cooling in air;

pause at 560° C. for 8 h; and cooling in air.

The invention is naturally not limited to the above description. Although the compositions and alloys described in detail include vanadium, molybdenum, chromium, and iron, the invention also covers alloys that include only some of them, or indeed only one of them, in the proportions specified, or in other proportions.

Furthermore, the proportion of oxygen may be increased to more than 0.3%.

Finally, the compositions and the alloys of titanium of the invention need not include any zirconium, silicon, or carbon (other than traces). Such alloys or compositions may include elements other than those specified above in proportions that do not harm the possibility of forging at temperatures close to the β→α+β polymorphic transition or the possibility of heat treatment with heating to a temperature close to the transition temperature in order to cause a β phase to appear in the half-finished product that is capable of coexisting with an α phase.

What is claimed is:

1. A forged aircraft landing gear composed of a titanium alloy, in addition to titanium constituting the majority proportion by weight, the alloy including at least the following elements, in the proportions by weight that are specified:

| | |
|---|---|
| aluminum | 4.0% to 7.5% |
| vanadium | 3.5% to 5.5% |
| molybdenum | 4.5% to 7.5% |
| chromium | 1.8% to 3.6% |
| iron | 0.2% to 0.5% |
| hafnium | 0.1% to 0.7% |
| oxygen | 0.1% to 0.3% |
| carbon | 0.01% to 0.2% |
| zirconium | 0.1% to less than 0.7%, |

wherein the combined proportion by weight of hafnium plus zirconium does not exceed 1%.

2. The forged aircraft landing gear part according to claim 1, further including silicon in a proportion by weight lying in the range 0.05% to 0.25%.

3. The forged aircraft landing gear part according to claim 1, wherein the proportions by weight of the elements constituting the titanium alloy are specified as:

| | |
|---|---|
| Aluminum | 7.0% |
| Vanadium | 4.5% |
| Molybdenum | 6.5% |
| Chromium | 3.0% |
| Iron | 0.4% |
| Hafnium | 0.5% |
| Zirconium | 0.5% |
| Oxygen | 0.3% |
| Carbon | 0.05% |
| Titanium | the balance. |

4. The titanium alloy according to claim 1, wherein the proportions by weight of the elements constituting the titanium alloy are specified as:

| | |
|---|---|
| Aluminum | 7.0% |
| Vanadium | 4.5% |
| Molybdenum | 6.5% |
| Chromium | 3.0% |
| Iron | 0.4% |
| Hafnium | 0.5% |
| Zirconium | 0.3% |
| Silicon | 0.15% |
| Oxygen | 0.3% |
| Carbon | 0.05% |
| Titanium | the balance. |

5. A method of production of a forged aircraft landing gear part composed of a titanium alloy, the method including the steps of:

forging the titanium alloy at a temperature close to the $\beta \rightarrow \alpha+\beta$ polymorphic transition temperature, said titanium alloys, in addition to titanium constituting the majority proportion by weight, including at least the following elements, in the proportions by weight that are specified:

| | |
|---|---|
| aluminum | 4.0% to 7.5% |
| vanadium | 3.5% to 5.5% |
| molybdenum | 4.5% to 7.5% |
| chromium | 1.8% to 3.6% |
| iron | 0.2% to 0.5% |
| hafnium | 0.1% to 0.7% |
| oxygen | 0.1% to 0.3% |
| carbon | 0.01% to 0.2% |
| zirconium | 0.1% to less than 0.7%, |

wherein the combined proportion by weight of hafnium plus zirconium not exceeding 1% heating the forged titanium alloy to a temperature in a range of 30° C. to 70° C. below the $\beta \rightarrow \alpha+\beta$ polymorphic transition temperature of the alloy;

pausing at said temperature for 2 h to 5 h;

cooling;

pausing at a temperature in the range 540° C. to 600° C for a period of 8 h to 16 h; and cooling.

* * * * *